US007557701B2

(12) United States Patent
Numazaki

(10) Patent No.: US 7,557,701 B2
(45) Date of Patent: Jul. 7, 2009

(54) BUILDING MONITORING SYSTEM

(75) Inventor: Takeshi Numazaki, Tokyo (JP)

(73) Assignee: NEC Corporation (JP)

( * ) Notice: Subject to any disclaimer, the term of this patent is extended or adjusted under 35 U.S.C. 154(b) by 335 days.

(21) Appl. No.: 11/682,369

(22) Filed: Mar. 6, 2007

(65) Prior Publication Data

US 2007/0210913 A1 Sep. 13, 2007

(30) Foreign Application Priority Data

Mar. 8, 2006 (JP) ..... 2006-062771

(51) Int. Cl.
*G08B 29/00* (2006.01)

(52) U.S. Cl. ..... 340/506; 340/507; 340/521; 340/540; 340/541; 340/517; 701/1; 701/36; 701/200

(58) Field of Classification Search ..... 340/506, 340/507, 521, 540, 541, 517; 701/36, 1, 701/200

See application file for complete search history.

(56) References Cited

U.S. PATENT DOCUMENTS 6,977,585 B2 * 12/2005 Falk et al. ..... 340/506

7,171,294 B2 * 1/2007 Kindo et al. ..... 701/36

FOREIGN PATENT DOCUMENTS

JP 2000-036092 2/2000

* cited by examiner

*Primary Examiner*—Tai T Nguyen
(74) *Attorney, Agent, or Firm*—Dickstein, Shapiro, LLP.

(57) ABSTRACT

A system enables safe and prompt communication in case of accident or fire. Detecting an emergency event, detection device 10 transmits emergency event information to each floor device 30 and to monitoring center device 40. Upon receipt of emergency event information, each of floor devices 30 and monitoring center device 40 display at least emergency event information and a point(s) of emergency contact. Each of floor devices 30 and monitoring center device 40 display image information taken by camera 20 related to the detection device which has detected the emergency event. Each of floor devices 30 and monitoring center device 40 may have call with the point(s) of emergency contact when the point(s) of emergency contact displayed is touched. In the call with the point(s) of emergency contact, each of the floor devices 30 and the monitoring center device 40 transmit the image information displayed to the point(s) of emergency contact.

6 Claims, 3 Drawing Sheets

BUILDING MONITORING SYSTEM

FIELD OF THE INVENTION

This invention relates to a building monitoring system for monitoring each floor of a building. More particularly, this invention relates to a building monitoring system which allows for prompt communication upon occurrence of an accident or on fire breakout.

BACKGROUND OF THE INVENTION

Among known building monitoring systems, there is such a building monitoring system in which notification may be made to a police station or a fire station when an accident or a fire has been located. For example, there is disclosed in Patent Publication 1 such a system in which security officers possess hand-held security terminals, an area controller is mounted from floor to floor or from monitor area to monitor area, and in which a master controller is mounted in a security staff room. The security terminal has the functions of wireless communication within the precinct of the building, PHS functions, the function of image pickup by an LCD monitor, or the function of actuating an alarm control device. Each area controller is able to have data communication with the security terminals or a call over a telephone, or perform image-shooting by a monitor camera, sensor actuation or alarm outputting. The master controller allows for data communication or a call over telephone with the security terminals, while performing communication control for the area controllers.

[Patent Document 1]

JP patent Kokai Publication No. JP-P2000-36092A

SUMMARY OF THE DISCLOSURE

The entire disclosure of the above Patent Document 1 is herein incorporated by reference thereto.

However, in the conventional building monitoring systems, in case an accident has occurred or a fire has broken out, and there is no security staff in a security staff room or on a floor of a building where the accident or the fire has occurred, the status of the site may not be notified in real time to the police or fire station. To grasp the status of the site in real time, the security staff has to go in person to the site to have a contact with the police or fire station, which may expose the security staff to a danger.

It is a principal object of the present invention to provide a system which, upon occurrence of an accident or a fire, will enable communication promptly in safety.

According to an aspect of the present invention, there is provided a monitoring system for a building, comprising a plural number of detection devices, a plural number of cameras for imaging each floor or each monitoring area of the building, a plural number of floor devices and a monitoring center device. The detection devices are mounted on each floor or in each monitoring area of the building for detecting the occurrence of an emergency event. The floor devices are mounted on each floor or in each monitoring area and include a display unit for displaying preset information, a touch panel unit which may be touched to select a point or points of emergency contact displayed on the display unit, and a call device that performs a call with the point of emergency contact as selected. The monitoring center device is mounted in a monitoring center of the building and includes a display unit for displaying the preset information, a touch panel unit which may be touched to select a point or points of emergency contact displayed on the display unit, and a call device that performs a call with the point or points of emergency contact as selected. Upon detection of an emergency event, the detection device transmits the emergency event information, inclusive of the contents and a site of the emergency event information, to each of the floor devices and to the monitoring center device. Upon receipt of the emergency event information, each of the floor devices and the monitoring center device display at least the emergency event information and a point or points of emergency contact. Each of the floor devices and the monitoring center device display the image information taken by the camera related to the detection device which has detected the emergency event.

In the monitoring system for a building, according to the present invention, each of the floor devices and the monitoring center device preferably transmits the image information displayed to the point or points of emergency contact incase of having a call with the selected point or points of emergency contact.

In the monitoring system for a building, according to the present invention, the monitoring center device upon receipt of the emergency event information preferably selects the camera in the vicinity of the location of the emergency event information, and distributes the image information, acquired from the selected camera, to each of the floor devices. Upon receipt of the image information, each of the floor devices displays the image information.

In the monitoring system for a building, according to the present invention, the detection device upon detection of an emergency event preferably transmits the emergency event information to the camera related to the emergency event. Upon receipt of the emergency event information, the camera preferably transmits the acquired image information to each of the floor devices and to the monitoring center device.

In the monitoring system for a building, according to the present invention, the monitoring center device preferably is connectable over an outside-building network to the mobile terminal. Upon receipt of the emergency event information, the monitoring center device preferably transmits the emergency event information to a mobile terminal.

In the monitoring system for a building, according to the present invention, each of the floor devices and the monitoring center device preferably are connectable over an outside-building network to a terminal or terminals of a point or points of emergency contact.

The meritorious effects of the present invention are summarized as follows.

According to the present invention, real-time communication, assisted by image, may be set up upon occurrence of an emergency event, among the site of the emergency event, monitoring center, police stations and the fire stations, so that proper actions may be taken more promptly responsive to the emergency event.

In case an emergency event, such as fire or earthquake, has occurred, those haphazardly present near each floor device or the monitoring center device where the emergency event has occurred can grasp the fact of occurrence of the emergency event based on the information displayed on each floor device or on the monitor center device.

Also, those haphazardly present near each floor device or the monitoring center device can simply touch the point or points of emergency contact displayed on the floor device or the monitoring center device with his/her finger to notify the police or fire station of the emergency event by a call over telephone.

PREFERRED MODES OF THE INVENTION

First Example

Figure 1:
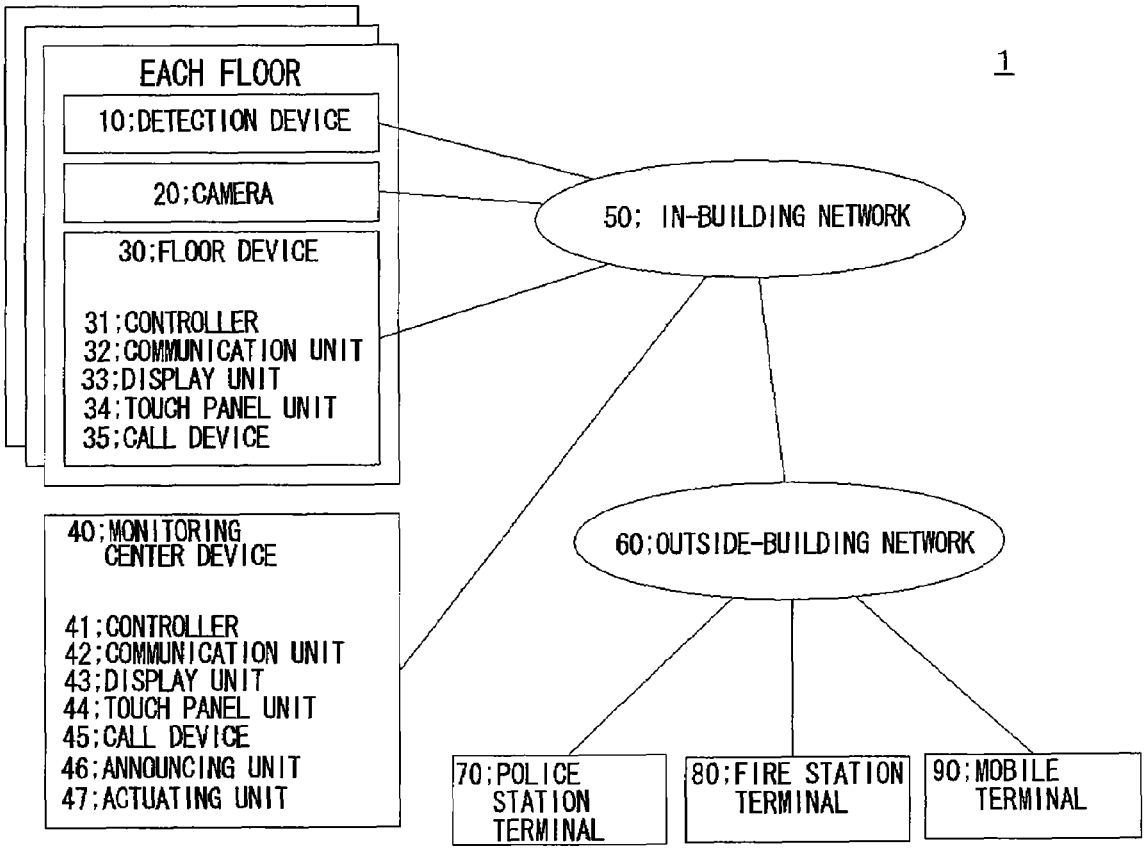
FIG. 1 is a schematic block diagram showing the constitution of a building monitoring system according to a first example of the present invention.
Figure 2:
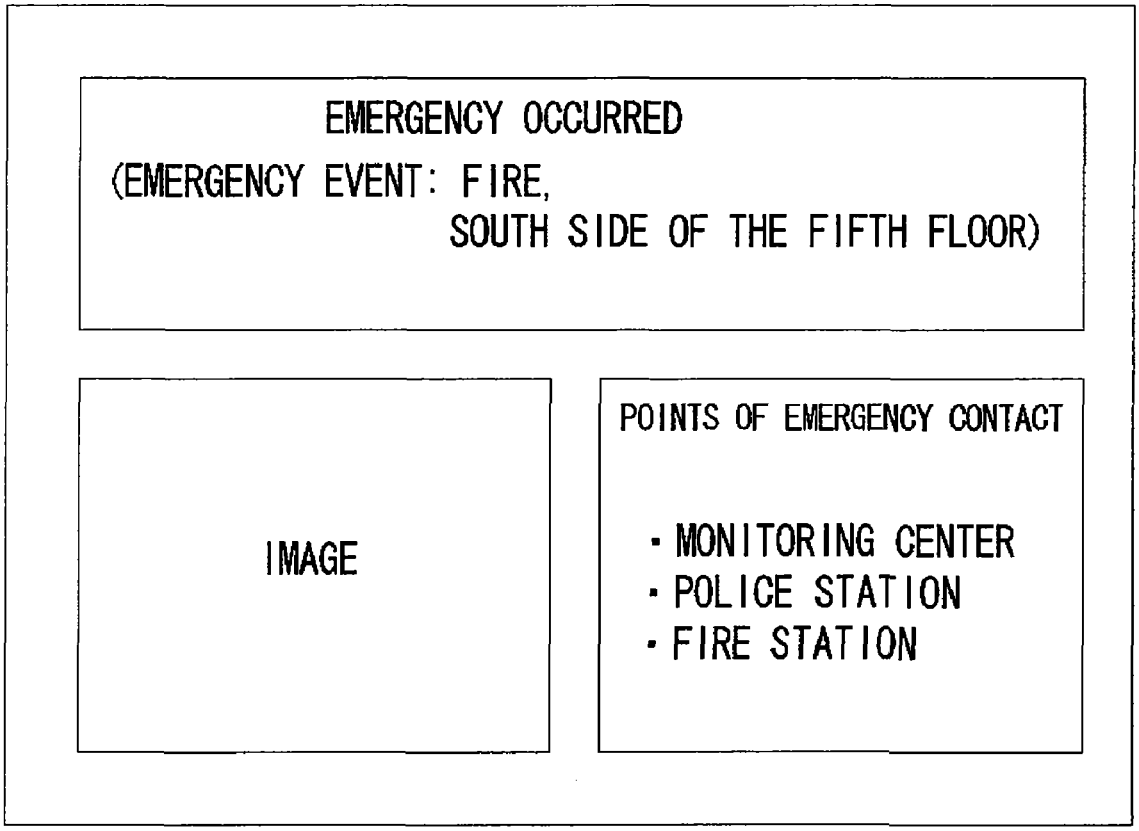
FIG. 2 is a diagrammatic view showing exemplary display in a floor device or a monitoring center device of the building monitoring system according to the first example of the present invention.

A building monitoring system according to a first example of the present invention will now be described with reference to the drawings. FIG. 1 is a block diagram schematically showing the building monitoring system according to a first example of the present invention. FIG. 2 is a diagrammatic view showing exemplary display in a floor device of the building monitoring system according to the first example of the present invention.

A building monitoring system 1 is a system for monitoring the respective floors of a building, and includes a detection device 10, a camera 20, a floor device 30, a monitoring center device 40 and an in-building network 50.

The detection device 10 is mounted in each floor or in each monitor area of the building to detect the occurrence of an emergency, such as earthquake or fire. The detection device may, for example, be an earthquake sensor, a fire sensor, a gas sensor, or a crime-preventive sensor, such as a destruction sensor or removal sensor, and is connected to an in-building network 50. The detection device 10 is connected to the in-building network 50 and, upon detection of occurrence of an emergency, transmits the emergency event information to each floor device 30 and to the monitoring center device 40. The emergency event information includes the information exemplified by the contents of the emergency (e.g. a fire) and the site (e.g. the south side of the fifth floor). One or more of the detection devices 10 may be provided per floor.

The camera 20 monitors by acquiring a moving image or a still image of each floor or each monitor area in a building, and is connected to the in-building network 50. The camera 50 is mounted on a base, not shown, and may be changed in orientation by actuation from the monitoring center device 40. Moreover, zooming of the camera 20 may be changed by actuation from the monitoring center device 40. The image information, obtained with the camera 20, is transmitted to the monitoring center device 40.

The floor device 30 is mounted on each floor or in each monitoring area of the building, and is connected to the in-building network 50. The floor device 30 includes a controller 31, a communication unit 32, a display unit 33, a touch panel unit 34, and a call device 35.

The controller 31 controls the other components 32 to 35. Upon receipt of the emergency event information from the detection device 10, the controller 31 exercises control for displaying the emergency event information, such as contents and site, and the point or points of emergency contact, such as monitoring center, police station or fire station, on the display unit 33 (see FIG. 2). Upon receipt of the image information from the monitoring center device 40, the controller 31 exercises control for displaying an image corresponding to the image information on the display unit 33 (see FIG. 2). The controller 31 accesses the point of emergency contact, more precisely, a related device at the point of emergency contact, at a touched point (icon image) on the touch panel unit 34, to exercise control to provide for communication between the point of emergency contact, more precisely a device at the point of emergency contact, and the call device 35. When communicating with the point of emergency contact, more precisely a device at the point of emergency contact, has become possible, the controller 31 exercises control to transmit the image information, displayed on the display unit 33, to the point of emergency contact, more precisely the related device at the point of emergency contact.

The communication unit 32 transmits and/or receives the preset information. The display unit 33 displays the contents of the emergency, the point or points of emergency contact, and an image. The touch panel unit 34 is provided on a display screen on the display unit 33 to notify the controller 31 of the point of emergency contact at the touched position. The call device 35 provides for call with the point of emergency contact, more precisely, a related device at the point of emergency contact.

The monitoring center device 40 is mounted in a monitoring center in the building, and is connected to the in-building network 50. The monitoring center device 40 includes a controller 41, a communication unit 42, a display unit 43, a touch panel unit 44, a call device 45, an announcing unit 46 and an actuating unit 47.

The controller 31 controls the other components 42 to 47. Upon receipt of the emergency event information from the detection device 10, the controller 41 exercises control for displaying the emergency event information, such as contents and site, and the points of emergency contact, such as police station or fire station, on the display unit 43. Upon receipt of the image information from the detection device 10, the controller 41 exercises control so that the camera 20 at a location closest to the site pertinent to the emergency event information is selected, the image information from the so selected camera 20 is acquired and distributed to each floor device 30, and so that an image corresponding to the image information is displayed on the display unit 43. Upon receipt of the emergency event information from the detection device 10, the controller 41 performs control to transmit the emergency event information, such as contents or site, to a mobile terminal 90. The controller 41 accesses the point of emergency contact, more precisely, a device at the point of emergency contact, at the touched position of the touch panel unit 44, to provide for a call between the device at the point of emergency contact and the call device 45. When the communication between the device at the point of emergency contact and the call device has become possible, the controller 41 exercises control to transmit the image information, displayed on the display unit 43, to the point of emergency contact, more precisely, to a device connected at the point of emergency contact.

The communication unit 42 transmits and/or receives the predetermined information. The display unit 43 displays the contents of the emergency, the point or points of emergency contact, and an image. The touch panel unit 44 is disposed on a display screen of the display unit 43, and notifies the controller 41 of the point or points of emergency contact manipulated at the touched position. The call device 45 provides for call with the device of the point of emergency contact. Upon receipt of the information on the emergency from the detection device 10, the announcing unit 46 announces the emergency with sound or light. The actuating unit 47 may change the orientation or the zoom of the camera 20 by a manual operation by a human operator.

The in-building network 50 is a communication network provided within the building, and is connectable to a police terminal 70, a fire terminal 80 or with the mobile terminal 90 via an outside-building network 60. The police terminal 70 is provided within a police station and has a call or display function, while the fire terminal 80 is provided in a fire station and also has a call or display function. The mobile terminal 90 may be carried by a security officer and has a mail function.

Figure 3:
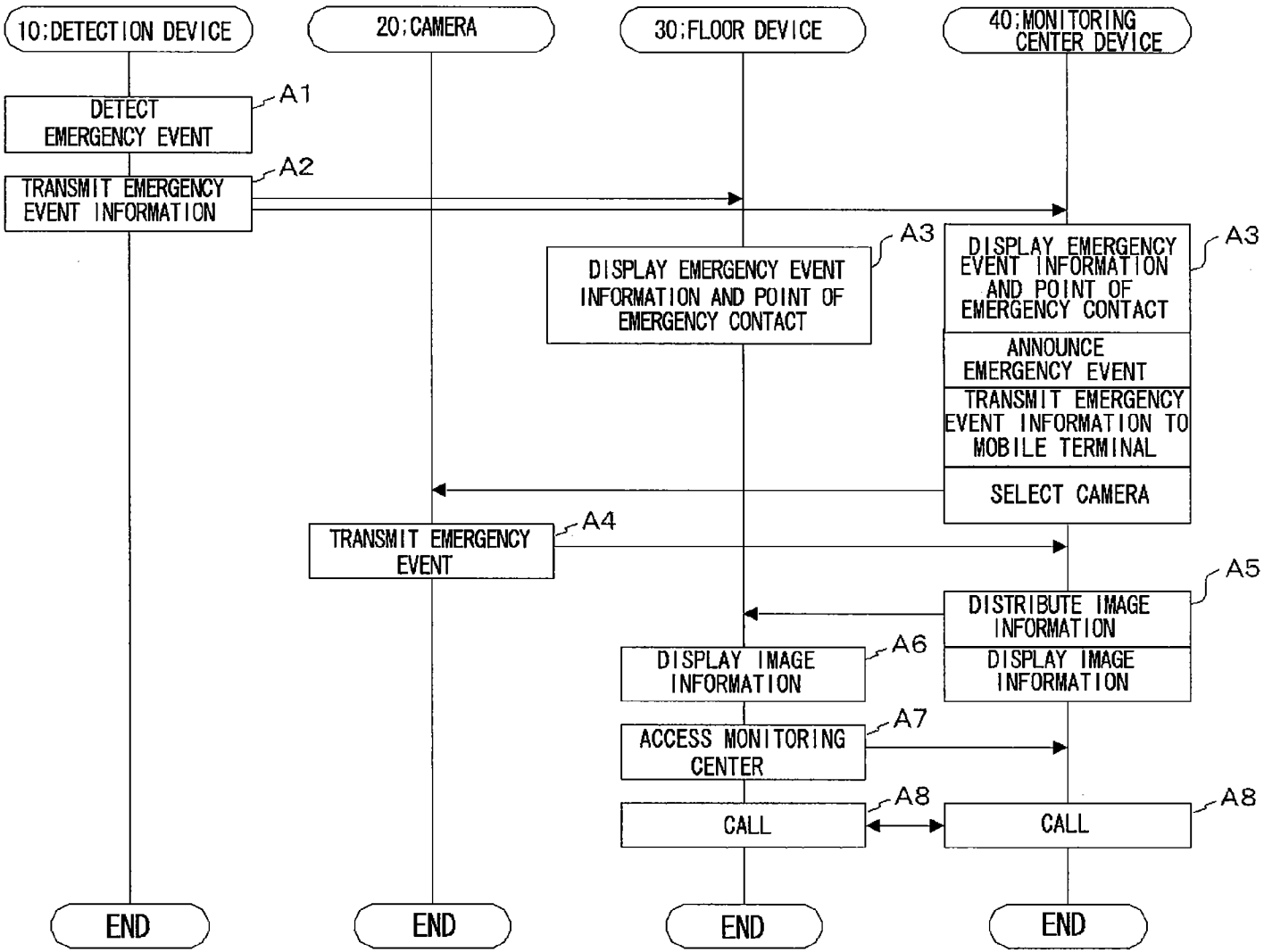
FIG. 3 is a flowchart schematically showing the operation of the building monitoring system according to the first example of the present invention.

The operation of the building monitoring system of the first example of the present invention will now be described with reference to the drawings. FIG. 3 depicts a flowchart schematically showing the operation of the building monitoring system.

Initially, upon occurrence of an emergency, such as earthquake or fire, the detection device 10 detects the emergency (step A1). Meanwhile, the detection device 10, monitoring the emergency at all times, detects the emergency when a state or a value has become different from the usual state or value, thus indicating an emergency. The detection device 10 then transmits the emergency event information, inclusive of the contents and the site of the emergency, such as a fire on the south side of the fifth floor, to each floor device 30 and to the monitoring center device 40 (step A2). Meanwhile, the detection device 10 holds the emergency event information from the outset in readiness for possible actual occurrence of an emergency.

Upon receipt of the emergency event information from the detection device 10, each floor device 30 and the monitoring center device 40 display the emergency event information and the point or points of emergency contact (step A3). At this time, each floor device 30 displays the monitoring center, police station and the fire station, while the monitoring center device 40 displays the police station and the fire station, as the points of emergency contact. Meanwhile, the points of emergency contact are held from the outset at each floor device 30 and at the monitoring center device 40. Hence, those on the site as well as the security officer(s) may communicate with the point of the emergency contact in real time, using each floor device 30 or the monitoring center device 40.

In the above step A3, the monitoring center device 40 announces the emergency with sound or light and transmits the emergency event information to the mobile terminal (90 of FIG. 1) as necessary. The monitoring center device selects the camera 20 at a location closest to the site of the emergency event information.

The camera 20 then transmits the image information to the monitoring center device 40 (step A4). Meanwhile, the camera 20 may be transmitting the image information at all times to the monitoring center device 40. If, in this case, the monitoring center device 40 selects the camera 20 at a location closest to the site of the emergency event information, the image information from the camera 20 may be distributed at all times to the floor devices 30. A monitoring officer at the monitoring center device 40 also may remote-control the orientation or zooming of the selected camera 20, using the monitoring center device 40, to display the real status of the emergency site correctly.

The monitoring center device 40 then distributes the image information from the selected camera 20 to each floor device 30 (step A5). At this time, the monitoring center device 40 displays the image information from the selected camera 20. The monitoring center device 40 may then distribute the image information to the device of emergency contact.

Next, each floor device 30 displays the image information from the monitoring center device 40 (step A6). Each floor device 30 may then distribute the image information to the device of emergency contact.

If somebody haphazardly present near an optional floor device 30 touches an icon of the monitoring center as site of emergency contact, displayed on the floor device 30, with his/her finger, the floor device 30 accesses the monitoring center device 40 (step A7). If the monitoring officer then accesses the floor device 30 through the monitoring center device 40, a call may be had between the floor device 30 and the monitoring center device 40 (step A8).

If a person who is haphazardly present near an optional floor device 30 touch an icon of the police or fire station, as a point of emergency contact, displayed on the floor device 30, with his/her finger, the floor device 30 accesses the police terminal 70 or the fire terminal 80. An operator at the police terminal 70 or the fire terminal 80 accepts the access from the floor device 30, whereby a call is made possible, at the same time as the image information displayed on the floor device 30 is transmitted to the police terminal 70 or the fire terminal 80.

With the first example, real-time communication, assisted by an image, may be established for the site, monitoring center, police station and the fire station, so that a more prompt and more proper action may be taken in keeping with a concrete event of emergency.

In addition, those persons present haphazardly in the vicinity of each floor device 30 or the monitoring center device 40 upon occurrence of the emergency, such as fire or earthquake, may grasp the event of occurrence of the emergency from the information displayed on each floor device 30 or on the monitoring center device 40.

Moreover, those haphazardly present in the vicinity of each floor device 30 or the monitoring center device 40 may readily notify the police station or the fire station of the emergency event by simply touching the point or points of emergency contact displayed on each floor device 30 or the monitoring center device 40.

MODIFICATION

In the first example, the monitoring center device 40 selects the camera 20 in the vicinity of the site based on the emergency event information as detected by the detection device 10. Alternatively, the emergency event information from the detection device 10 may directly be transmitted to the camera 20 related with the site to promptly select the camera 20. Moreover, in the first example, the image information displayed on the floor device 30 is distributed from the monitoring center device 40. Alternatively, the image information from the camera 20 may also be directly transmitted to each floor device 30 to display the image information promptly on each floor device 30.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A monitoring system for a building, comprising:

a plurality of detection devices mounted on each floor or in each monitoring area of said building for detecting occurrence of an emergency event;

a plurality of cameras for imaging each floor or each monitoring area of said building;

a plurality of floor devices mounted on each floor or in each monitoring area and including a display unit for displaying preset information, a touch panel unit which may be touched to select a point or points of emergency contact displayed on said display unit, and a call device that performs a call with the point of emergency contact as selected; and a monitoring center device mounted in a monitoring center of said building and including a display unit for displaying the preset information, a touch panel unit which may be touched to select a point or points of emergency contact displayed on said display unit, and a call device that performs call with the point or points of emergency contact as selected; wherein said detection device upon detection of an emergency event transmits emergency event information, inclusive of contents and a site of said emergency event information, to each of said floor devices and to said monitoring center unit;

each of said floor devices and said monitoring center device display, upon receipt of said emergency event information, at least said emergency event information and a point or points of emergency contact;

each of said floor devices and said monitoring center device display image information as taken by said camera related to said detection device which has detected said emergency event.

2. The monitoring system for a building according to claim 1 wherein, in providing for a call with the selected point or points of emergency contact, each of said floor devices and said monitoring center device transmits the image information displayed to said point or points of emergency contact.

3. The monitoring system for a building according to claim 1 wherein, upon receipt of said emergency event information, said monitoring center unit selects said camera in the vicinity of a location of said emergency event information, and distributes the image information acquired from the selected camera to each of said floor devices;

each of said floor devices upon receipt of said image information displaying said image information.

4. The monitoring system for a building according to claim 1 wherein said detection device upon detection of an emergency event transmits said emergency event information to a camera related to said emergency event;

said camera upon receipt of said emergency event information transmitting the image information as shot to each of said floor devices and to said monitoring center device.

5. The monitoring system for a building according to claim 1 wherein said monitoring center device is connectable over an outside-building network to said mobile terminal; and wherein said monitoring center unit upon receipt of said emergency event information transmits said emergency event information to said mobile terminal.

6. The monitoring system for a building according to claim 1 wherein each of said floor devices and said monitoring center device are connectable over an outside-building network to a terminal or terminals of a point or points of emergency contact.

* * * * *